United States Patent [19]

Ringley

[11] Patent Number: 4,574,032

[45] Date of Patent: Mar. 4, 1986

[54] PROCESS FOR DELIGNIFICATION OF LIGNOCELLULOSIC MATERIAL IN THE PRESENCE OF ANTHRAQUINONE IN SOLUTION WITH WHITE AND BLACK LIQUORS

[75] Inventor: Michael B. Ringley, Charleston Hgts., S.C.

[73] Assignee: Westvaco Corporation, New York, N.Y.

[21] Appl. No.: 359,202

[22] Filed: Mar. 18, 1982

Related U.S. Application Data

[63] Continuation of Ser. No. 84,930, Oct. 15, 1979, abandoned.

[51] Int. Cl.[4] ..... D21C 3/02; D21C 3/20; D21C 3/26; D21C 11/00

[52] U.S. Cl. ..... 162/38; 162/72; 162/82

[58] Field of Search ..... 162/19, 72, 65, 90, 162/40, 45, 38, 39, 82

[56] References Cited

U.S. PATENT DOCUMENTS

| | | | |
|---|---|---|---|
| 4,012,280 | 3/1977 | Holton | 162/65 |
| 4,127,439 | 11/1978 | Fujii et al. | 162/40 |
| 4,178,861 | 12/1979 | Vanderhoek et al. | 162/90 |
| 4,213,867 | 7/1980 | Vanderhoek . | |

FOREIGN PATENT DOCUMENTS

| | | | |
|---|---|---|---|
| 2460144 | 7/1975 | Fed. Rep. of Germany | 162/65 |
| 52-155202 | 12/1977 | Japan | 162/90 |

OTHER PUBLICATIONS

"Kraft Pulping with Anthraquinone," H. H. Holton and F. L. Chapman, *Tappi*, vol. 60, No. 11, 121–5 (1977).

"Soda Additive Softwood Pulping: A Major New Process," H. H. Holton, *Pulp and Paper Canada*, vol. 78, No. 10, T 218–23 (1977).

"Soda Pulping with Anthrahydroquinones," T. J. Fullerton, *Appita*, vol. 32, No. 2, 117–8 (1978).

*Primary Examiner*—Steve Alvo

*Attorney, Agent, or Firm*—Terry B. McDaniel; Richard L. Schmalz

[57] ABSTRACT

A method of introducing anthraquinone into the kraft pulping process for the delignification of lignocellulosic material by dissolving or homogeneously dispersing the anthraquinone in a mixture of from about 10% to about 50% white kraft pulping liquor and, correspondingly, from about 90% to about 50% black kraft pulping liquor and then blending this solution with the white liquor feed into the pulping digesters.

3 Claims, 1 Drawing Figure

PROCESS FOR DELIGNIFICATION OF LIGNOCELLULOSIC MATERIAL IN THE PRESENCE OF ANTHRAQUINONE IN SOLUTION WITH WHITE AND BLACK LIQUORS

This is a continuation of application Ser. No. 084,930, filed Oct. 15, 1979, now abandoned.

BACKGROUND OF THE INVENTION (1) Field of the Invention

This invention relates to an improved process for the delignification of lignocellulosic material, such as wood, with an alkaline pulping liquor of the kraft, or sulfate, alkaline pulping process. More particularly, the invention relates to lignocellulosic material delignification with kraft pulping liquors containing anthraquinone as a pulping additive. Specifically, the invention relates to a method of solubilizing anthraquinone for introduction into the pulping process.

(2) Description of the Prior Art

The processing of lignocellulosic material to produce cellulose suitable for the manufacture of paper products involves the removal of lignin and other non-cellulosic components such as gums. Reagents that attack lignin without affecting appreciably the cellulose component are preferred for this purpose. In the sulfate or kraft process lignocellulosic material is cooked with a mixture of sodium hydroxide and sodium sulfide. This alkaline solution is called "white liquor" when freshly prepared and is referred to as "black liquor" when recovered from the pulping process. In the soda process the cooking is carried out with sodium hydroxide alone.

Recently, U.S. Pat. No. 4,012,280 to H. H. Holton disclosed that certain cyclic keto compounds, in particular anthraquinone and its derivatives, when employed as an additive in the kraft and soda pulping processes act to accelerate the pulping action and increase yield.

Unfortunately, anthraquinones are not generally soluble in the alkaline pulping liquors prior to cooking and this could cause problems in using them commercially. For this very reason, T. J. Fullerton, in *Appita* 32(2): 117-18 (1978), suggests soda pulping with anthrahydroquinones, which are soluble in alkaline solution.

In a paper by Holton and Chapman (*Tappi* 60(11): 121–5 (1977)), 0.05% anthraquinone was used for kraft pulping southern pine chips to produce linerboard grade pulp. The method of introducing the anthraquinone into the digesters in these mill trials was to add the anthraquinone "continuously at the bottom of the chip conveyor belt, on top of the chips."

Anthraquinone is not considered to be a particularly toxic chemical. It has a slight allergic effect on sensitive people. However, because it is usually handled as a very fine powder, it is difficult to prevent significant amounts from becoming suspended in the air. This can even lead to an explosion hazard. Because of this, protective clothing, including rubber gloves and a dust mask, is recommended when handling large amounts of anthraquinone powder.

The ability to solubilize or stably disperse anthraquinone in kraft pulping liquors so that it may be added to the chips as a homogeneous solution or dispersion would provide important advantages in industrial applications.

Surprisingly, it has been discovered, after unsuccessful attempts to achieve a stable dispersion of anthraquinone in white liquor, that the addition of black liquor to the anthraquinone-white liquor mixture causes the anthraquinone to disappear into solution or into a finely dispersed colloidal system.

SUMMARY OF THE INVENTION

The invention provides a method for introducing anthraquinone into the pulping digesters in the form of a homogeneous solution or dispersion with the kraft pulping liquors by first admixing the anthraquinone with from about 10% to about 50% white liquor and, correspondingly, from about 90%, to about 50% black liquor and then feeding this white liquor-black liquor-anthraquinone solution into the digesters. The invention method employs an apparatus extraneous to the conventional pulping apparatus (i.e., digesters) to include: a container for the admixture; separate means for introducing white liquor, black liquor and anthraquinone into the container, optional means for agitating or stirring the mixture within the container; and means for feeding the mixture into the digester prior to pulping.

DESCRIPTION OF THE PREFERRED EMBODIMENTS

Figure 1:
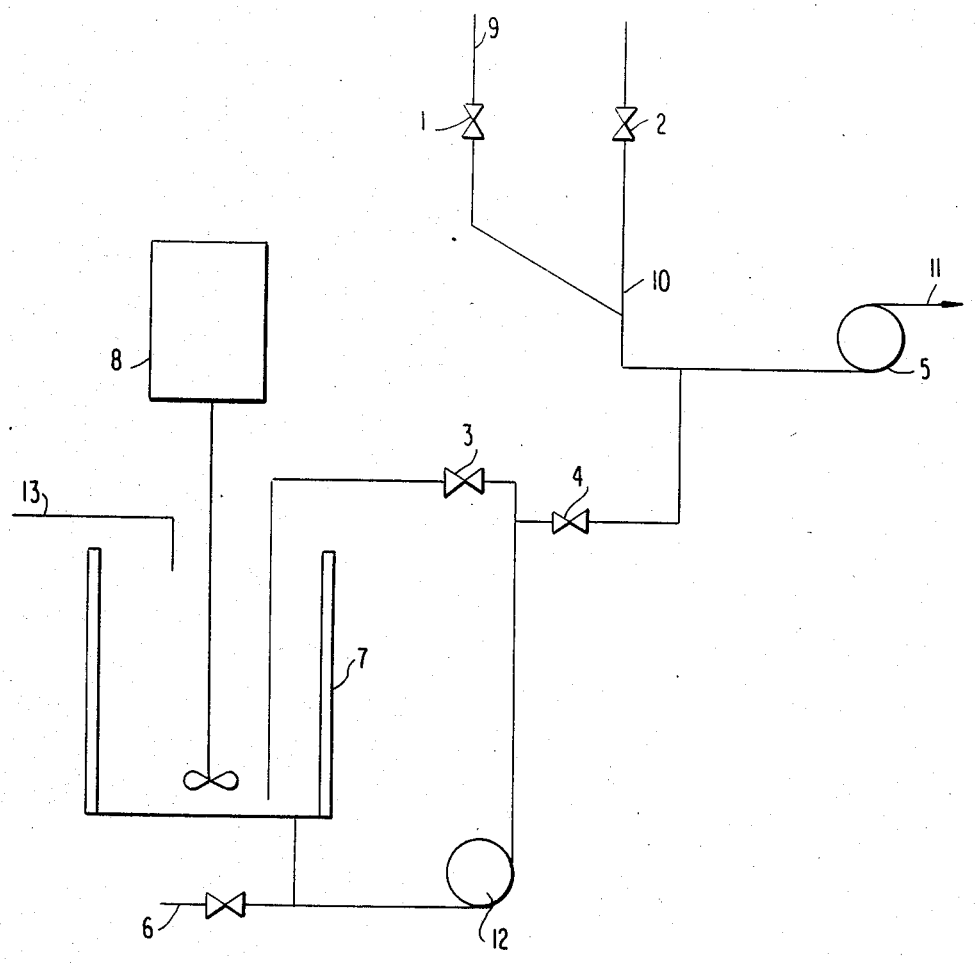
FIG. 1 shows one possible configuration of an apparatus which may be employed in the invention process. The essential elements are the admixing container (7), black liquor line (9), white liquor line (10), pump (12) for pumping the anthraquinone dispersion to blend with white liquor and pump (5) to pump the white liquor diluted anthraquinone dispersion to the digesters.

A process for the delignification of lignocellulosic material using anthraquinone as a pulping additive involves first treating the lignocellulosic material in a closed reaction vessel, such as a kraft digester, with a kraft pulping liquor containing from 0.001% to 10.0% by weight based on the lignocellulosic material of anthraquinone, the treatment taking place at a maximum temperature of from 150° C. to 200° C. for a period of 0.5 to 480 minutes. Next the pulping liquor is discharged from the lignocellulosic material. And, finally, the lignocellulosic material is washed with water or an aqueous liquor inert to the lignocellulosic material, such as "white water" from a later stage of the papermaking process, to obtain a delignified cellulosic material.

The present invention involves an improvement in kraft pulping with anthraquinone which includes, prior to adding the anthraquinone to the digester, combining the anthraquinone with from 10% to 50% white liquor and, correspondingly, from 90% to 50% black liquor. This procedure permits further reductions in cooking time and active alkali (pulping liquor) consumption over processes which do not achieve a uniform dispersion of the anthraquinone throughout the lignocellulosic material. The improved procedure, allowing anthraquinone to be added to the lignocellulosic material in a homogeneous solution, also provides health and safety advantages in industrial applications.

A preferred embodiment of the improved process employs an apparatus for the pre-cook preparation of the white liquor-black liquor-anthraquinone solution. The novel apparatus includes: a container for receiving and mixing the solution components, separate means for introducing white liquor, black liquor and anthraquinone into the container; optional means for agitating or stirring the solution within the container; and means for feeding the solution into the digester prior to pulping. In an optional preferred embodiment, the means for feeding the solution into the digester includes a means for blending the solution with white liquor as the white liquor is fed into the digester prior to pulping. A suitable apparatus is shown in FIG. 1.

In a preferred embodiment of the invention white liquor is fed through a white liquor line 10 and valves 2, 4 and 3 into a container 7 in an amount from about 10% to about 50% by volume of the total white liquor-black liquor mixture. Next, black liquor is fed through a black liquor line 9 and valves 1, 4 and 3 into the container 7 in an amount from about 90% to about 50% by volume of the total white liquor-black liquor mixture. The means for adding anthraquinone to the white liquor-black liquor mixture in the container 7 is depicted by anthraquinone feed line 13. Alternate methods may be employed to introduce the anthraquinone into the container from dumping the pre-measured amount of anthraquinone into the container by hand to employing an automated screw feed assembly. Also, the order of addition of the three components is not critical to the invention and any variation in the order of addition will result in a homogeneous solution of anthraquinone. The anthraquinone is added in proportions from 0.001% to 10.0%, preferably 0.01% to 1.0%, by weight based on the lignocellulosic material.

Although not essential to the formation of a homogeneous solution, a stirrer 8 may be employed to speed mixing. The stirrer 8 also may be used in conjunction with washing the container 7. Valve 6 is provided for convenience in the event it becomes necessary to drain the container 7 contents, for instance, wash water.

After preparation of the anthraquinone solution, it is transferred from the bottom of the container 7 by pumps 12 and 5 and through valve 4 into the digester 11. Preferably the anthraquinone solution is blended with white liquor as the latter is fed through valve 2 and pump 5 into the digester 11. It is also noted that the configuration shown in FIG. 1 provides for the re-circulation of the anthraquinone solution from the container 7 by pump 12 through valve 3 and back into the container 7 during the pulping process by closing valve 4.

The operation of the invention process is further described in the following example.

EXAMPLE

To test the invention process for introducing anthraquinone into a kraft digester for use as a kraft pulping additive in the delignification of pine wood chips, a 209 liter drum was charged with approximately 40 liters of white liquor. To the white liquor were added approximately 160 liters of black liquor. A pump connected to an opening in the bottom of the drum was then started to recirculate the contents of the drum. With the drum contents circulating, 16.75 kilograms of anthraquinone were added slowly to the container. The amount of anthraquinone was based on a digester charge of 25,000 kilograms of pine chips, or 0.067% by weight of the wood chips. A homogeneous solution of white liquor, black liquor and anthraquinone was quickly formed. The anthraquinone solution was added to a kraft digester containing the wood chips during the digester white liquor charging by injecting the anthraquinone solution into the suction side of the white liquor pump until the drum was empty.

Using the described procedure for introducing anthraquinone into the kraft digesters resulted in an alkali charge reduction from 3.41 tons to 3.15 tons per digester over the kraft pulping process without adding anthraquinone. Also, the anthraquinone pulping tests using the invention process achieved an average cooking time of 152 minutes as compared to an average cooking time of 167 minutes without anthraquinone.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

I claim:

1. In the process for the delignification of lignocellulosic material by (a) treating the lignocellulosic material in a closed reaction vessel with a kraft pulping liquor containing from 0.001% to 10.0% by weight, based on the lignocellulosic material, of anthraquinone, the treatment taking place at a maximum temperature of from 150° C. to 200° C. for a period of from 0.5 to 480 minutes, (b) discharging the pulping liquor from the lignocellulosic material, and (c) washing the lignocellulosic material with water or an aqueous liquor inert to the lignocellulosic material to obtain a delignified cellulosic material, a preliminary step consisting essentially of introducing the anthraquinone into the vessel in solution first formed by combining the anthraquinone with a mixture consisting of from 10% to 50% by volume white liquor and, correspondingly, from 90% to 50% by volume black liquor, wherein the volume percentages are based on the total volume of the white liquor-black liquor mixture.

2. The process of claim 1 wherein the kraft pulping liquor contains from 0.01% to 1.0% by weight, based on the lignocellulosic material of anthraquinone.

3. The process of claim 1 wherein the solution is formed by combining 0.067% by weight, based on the lignocellulosic material, of anthraquinone with a mixture of 80% by volume black liquor and 20% by volume white liquor wherein the volume percentages are based on the total volume of the white liquor-black liquor mixture.

* * * * *